US007845490B2

(12) United States Patent
Moore et al.

(10) Patent No.: US 7,845,490 B2
(45) Date of Patent: Dec. 7, 2010

(54) SIDE OPENING PACK BLANK DESIGN

(75) Inventors: Pamela D. Moore, Gloucester, VA (US); Eric D. Schardt, Powhatan, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 12/358,932

(22) Filed: Jan. 23, 2009

(65) Prior Publication Data

US 2009/0188818 A1 Jul. 30, 2009

Related U.S. Application Data

(60) Provisional application No. 61/006,699, filed on Jan. 28, 2008.

(51) Int. Cl.
*B65D 85/00* (2006.01)

(52) U.S. Cl. ..... 206/268; 206/273

(58) Field of Classification Search ..... 206/242, 206/259, 264, 265, 268, 271, 273
See application file for complete search history.

(56) References Cited

U.S. PATENT DOCUMENTS

| | | | | |
|---|---|---|---|---|
| 2,339,656 A | | 1/1944 | Shina | |
| 2,904,169 A | * | 9/1959 | Keating | 206/273 |
| 2,944,726 A | | 7/1960 | McCauley | |
| 2,956,722 A | | 10/1960 | Prussack | |
| 2,958,418 A | | 11/1960 | O'Gorman | |
| 3,105,591 A | | 10/1963 | Ahlbor | |
| 3,814,301 A | | 6/1974 | Niepmann | |
| 3,823,865 A | | 7/1974 | Mechnick | |
| 4,015,769 A | | 4/1977 | Erlich | |
| 4,165,804 A | | 8/1979 | Georgopoulos | |
| 4,948,038 A | | 8/1990 | Moeller | |
| 5,097,948 A | | 3/1992 | Campbell | |
| D393,924 S | | 4/1998 | Wright | |
| 5,788,066 A | * | 8/1998 | Focke et al. | 206/268 |
| 5,957,280 A | | 9/1999 | Focke et al. | |
| 6,105,856 A | * | 8/2000 | Kakiuchi | 229/148 |
| D541,471 S | | 4/2007 | Mitten et al. | |
| 2005/0103654 A1 | | 5/2005 | Hennessy | |

FOREIGN PATENT DOCUMENTS

| | | | |
|---|---|---|---|
| DE | 102006021991 | A1 | 11/2007 |
| EP | 1712470 | A1 | 10/2006 |
| WO | WO2005113386 | A1 | 12/2005 |

OTHER PUBLICATIONS

International Search Report and Written Opinion mailed May 29, 2009 for PCT/EP2009/000526.
International Preliminary Report on Patentability issued Aug. 3, 2010 for PCT/EP2009/000526.

* cited by examiner

*Primary Examiner*—Jacob K Ackun, Jr.
(74) *Attorney, Agent, or Firm*—Buchanan Ingersoll & Rooney PC

(57) ABSTRACT

A cigarette package, which includes an outer box and an inner frame. The outer box includes a lower box portion and a side opening hinged lid. The inner frame includes a front panel, a back panel, and a side panel extending between the front panel and the back panel. The outer box includes a tab and the inner frame includes a notch, such that the notch engages the tab when the hinged lid is in a closed position.

16 Claims, 9 Drawing Sheets

SIDE OPENING PACK BLANK DESIGN

CROSS-REFERENCE TO RELATED APPLICATION

This application claims priority to U.S. Patent Provisional Application No. 61/006,699, filed Jan. 28, 2008, which is incorporated herein by this reference in its entirety.

BACKGROUND

Cigarette packages perform the functions of containing a pre-selected bundle of cigarettes and protecting the cigarettes from mechanical and environmental damage. In addition, a package protects the freshness of the cigarettes.

Cigarette packages are typically made from paper into the so-called soft package that tears open on a top panel, and from paperboard into the so-called hard package that typically includes an integral reclosable lid. Both types of packages generally include a foil or foil laminate wrapped around the cigarettes, and an additional sealed plastic film, typically polypropylene, wrapped around the outside of the package. The foil wrapper and outer plastic film are included to maintain the freshness of the packaged cigarettes.

SUMMARY

In accordance with one embodiment, a cigarette package comprises: an outer box, the outer box including a lower box portion and a side opening hinged lid, and wherein the side opening hinged lid covers an opening in the lower box portion; and an inner frame, which prevents the hinged lid from misaligning when the hinged lid is opened past the inner frame and closed, the inner frame including a front panel, a back panel, and a side panel extending between the front panel and the back panel.

In accordance with another embodiment, a cigarette package comprises: an outer box, the outer box including a lower box portion and a side opening hinged lid, the side opening hinged lid having a tab, and wherein the side opening hinged lid covers an opening in the lower box portion; an inner frame having a notch therein; and wherein the notch engages the tab when the hinged lid is in a closed position.

In accordance with a further embodiment, a cigarette package comprises: an outer box, the outer box includes a left panel having a free edge, a front panel attached to the left panel at a fold line, a right panel attached to the front panel at a fold line, the right panel having a tab, a back panel attached to the right panel at a fold line, and a glue panel extending from the back panel at a fold line, the glue panel being glued to the underside of the left panel; and an inner frame, the inner frame including a front panel, a back panel, and a side panel extending between the front and back panels, the side panel having a notch, which engages the tab when a hinged lid portion of the outer box is in a closed position.

In accordance with another embodiment, a hinge lid box comprises a lower body portion having a front panel and a side panel said box further comprising an inner frame, a lid and a hinge defined across said side panel so that the lid is rotatable from a closed position to an opened position at an angle relative to said front panel, said inner frame including a vanguard adjacent said hinge to reduce edge to edge snags between the lid and the inner frame during reclosure.

BRIEF DESCRIPTION OF THE DRAWING FIGURES

DETAILED DESCRIPTION

In accordance with one embodiment, it would be desirable to have a cigarette package comprised of an outer box, and an inner frame, which is designed to fold up horizontally, i.e., around a foil bundle to form a side opening package from which the hinged lid opens on the narrow side of the pack. In accordance with an embodiment, the inner frame extends beyond an upper portion of the outer box, and the hinged lid is moveable from an open position at which the hinged lid extends beyond the inner frame to a closed position at which the hinged lid is guided onto the inner frame. Thus, the inner frame provides the package with a design that prevents the lid from misaligning when the lid is opened past the inner frame, and then closed.

In accordance with another embodiment, the outer box includes a tab, and the inner frame includes a notch, such that the notch engages the tab when the hinged lid is in a closed position to an open position at which the tab disengages the notch. It can be appreciated that the tab and the notch act as a retention mechanism to hold the lid in place while in a closed position. In addition, the tab and notch make a "clicking" noise when opened and closed providing an auditory acknowledgment that the pack or package has been opened or closed.

Figure 1A:
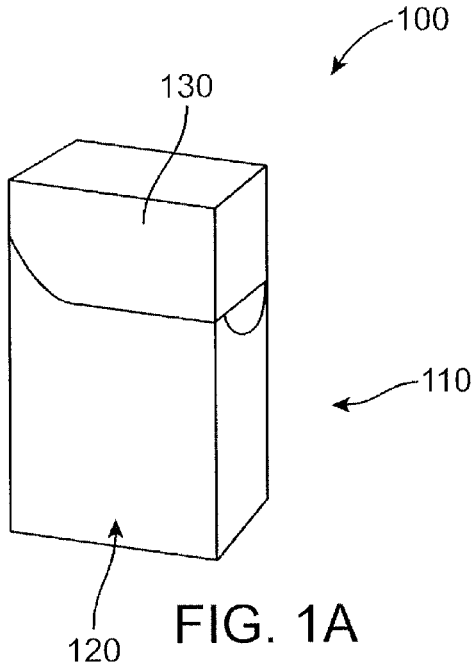
FIG. 1A is a perspective view of a cigarette package.

FIG. 1A shows a cigarette package 100 (or pack), which is comprised of an outer box 110, which is adapted to receive a framed bundle 140 (FIG. 2) of cigarettes. The outer box 110 is preferably comprised of a lower box portion 120 and a side opening hinged lid (or hinged top) 130, wherein the side opening hinged lid 130 covers an opening in the lower box portion (or lower body portion) 120. The hinged lid 130 pivots relative to the box portion 120, permitting the pack to be opened and reclosed. As shown in FIG. 1, the hinged lid 130 connects to the box portion 120 along an axis of articulation, which is normally along an edge of a longitudinal side wall of the box or a fold line, which is, located parallel to the edge of the box. The enclosed articles are held within the box portion 120, which is uncovered upon articulation of the hinged lid 130 about the fold line.

Figure 1B:
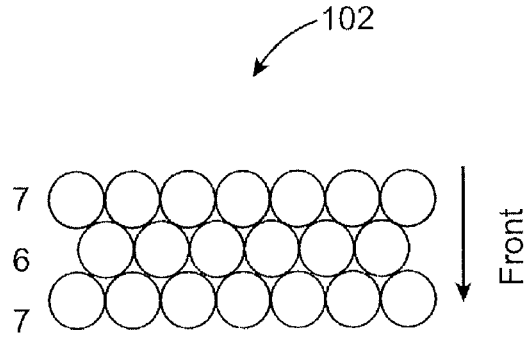
FIG. 1B is a top view of a group of smoking articles or cigarettes in accordance with an embodiment.
Figure 2:
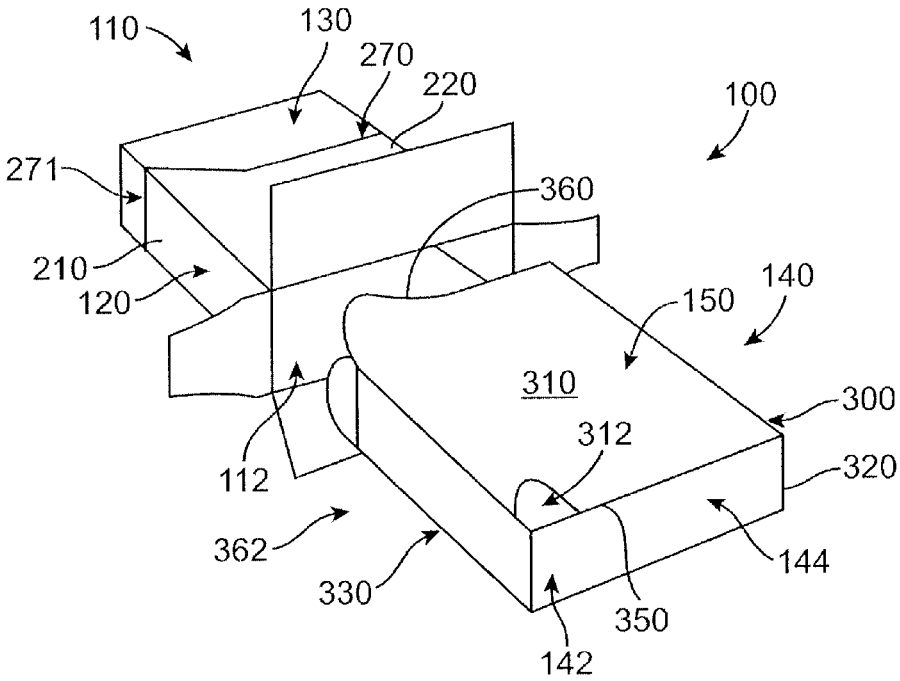
FIG. 2 is an exploded perspective view of a cigarette package comprising an outer box and a framed bundle formed of a foil bundle and an inner frame in accordance with one embodiment.

The framed bundle 140 comprises an inner frame 150 and a foil bundle 142 (FIG. 2). The foil bundle 142 includes a group of smoking articles or cigarettes 102 wrapped in a foil wrapper 144. The foil wrapper 144 is preferably a thin composite sheet comprised of an aluminized surface, which is wrapped around the group of smoking articles or cigarettes 102. As shown in FIG. 1B, the smoking articles or cigarettes 102 are placed or stacked in rows comprised of a first row of seven (7) cigarettes, a second or middle row of six (6) cigarettes, and a third row of seven (7) cigarettes for a pack of twenty (20) cigarettes.

In accordance with one embodiment, the inner frame 150 folds tip horizontally around the foil bundle 142 to form a top opening package from which the hinged lid 130 opens on a narrow side of the outer box 110. The foil bundle 140 is subsequently placed inside the lower box portion 120 of the cigarette package 100. The package 100 is typically covered with a transparent sheet, generally of acetate, cellophane, or polypropylene (not shown).

FIG. 2 shows an exploded perspective view of a cigarette package 100. The cigarette package 100 is similar to the so-called hinge-lid box cigarette package and comprises an outer box 110 and a framed bundle 140 inserted within the outer box 110. The outer box 110 is preferably formed from an outer box blank (or pack blank) 200 (FIG. 5) having a left panel 210, a front panel 220, a right panel 230, and a back panel 240. The front panel 220, the right panel 230 and the back panel 240 include a separation line 270 forming a hinged top or hinged lid 130. In a preferred embodiment, the hinged lid (or hinged top) 130 opens from the side (i.e., narrow side) along a hinge line 271.

The framed bundle 140 comprises an inner frame 150 and a foil bundle 142, which includes a group of cigarettes 102 wrapped in a foil wrapper 144. The framed bundle 140 is inserted into an open end 112 of the outer box 110 during assembly. The inner frame 150 is formed from an inner frame blank 300 (FIG. 4), which includes a front panel 310, a back panel 330, and a side panel 320 extending between the front and back panels 310, 330. In accordance with one embodiment, the front and back panels 310, 330 include a top edge 360, which extends further into the hinged lid 130 on an open end 362 of the inner frame 150. The front and back panels 310, 330 have a bottom edge 350, which includes a pair of cavities 312, 332 positioned on the open end 362 of the inner frame 150.

Figure 3:
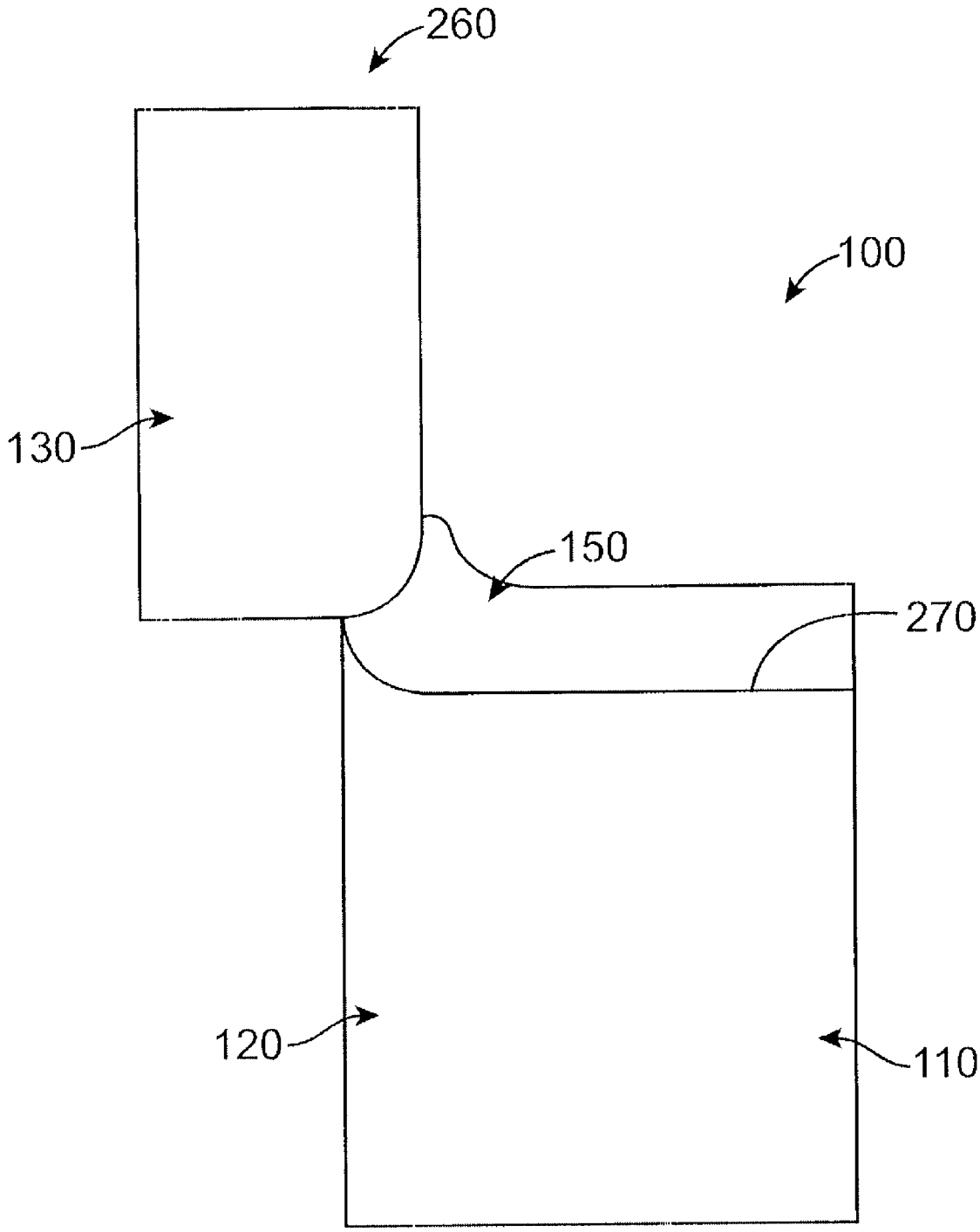
FIG. 3 is a side view of a cigarette package as shown in FIGS. 1 and 2 with the hinged lid in an open position.

FIG. 3 is a side view of a cigarette package 100 as shown in FIGS. 1 and 2 with the hinged lid 130 in an open position. The hinged lid 130 pivots relative to the box portion 120, permitting the pack 100 to be opened and reclosed. As shown in FIG. 3, the inner frame 150 extends beyond an upper portion (or separation line 270) of the outer box 110 such that the hinged lid 130 is moveable from an open position at which the hinged lid 130 extends beyond the inner frame 150 to a closed position at which the hinged lid 130 is guided onto the inner frame 150. In accordance with one embodiment, the inner frame 150 provides the package 100 with a design that prevents the hinged lid 130 from misaligning when the hinged lid 130 is opened past the inner frame 150, and then reclosed.

Figure 4:
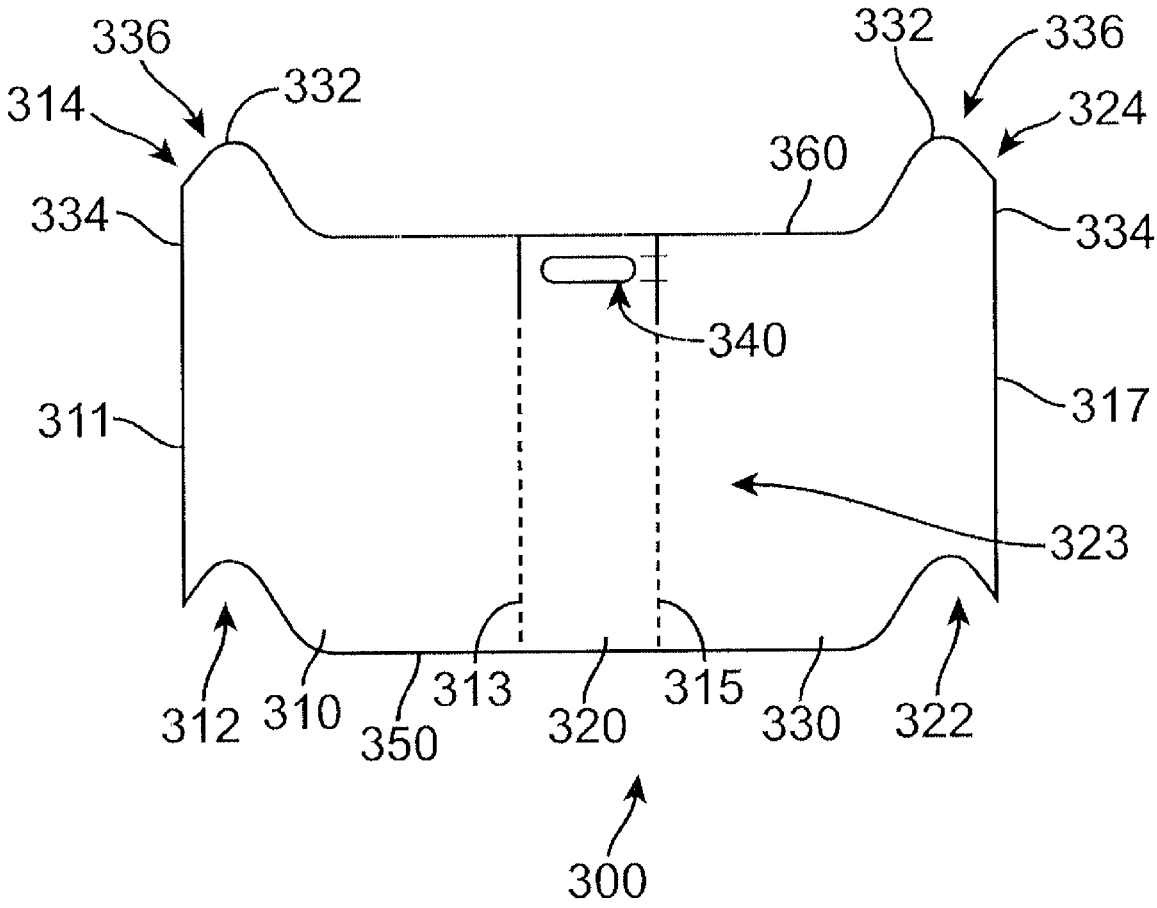
FIG. 4 is a plan view of an inner frame blank as shown in FIG. 2 in a spread out state.

FIG. 4 shows a blank of an exemplary embodiment of the inner frame 150 in the form of an inner frame blank 300 prior to assembly. As shown, the inner frame blank 300 includes a front panel 310 having a free edge 311, a back (or rear) panel 330 having a free edge 317, and a side panel 320 extending between the front and back panels 310, 330. The front panel 310 is attached to the side panel 320 at a fold line 313 and the back panel 330 is attached to the side panel 320 at a fold line 315.

In accordance with a preferred embodiment, the front and back panels 310, 330 include a bottom edge 350 and a top edge 360. The bottom edge 350 extends from free edge 311 to free edge 317 and includes a pair of cavities 312, 322, positioned on the open end, which is formed by the two free edges 311, 317 upon wrapping (i.e., horizontal folding) of the inner frame blank 300 around the foil bundle 142. The pair of cavities 312, 322 on the bottom edge 350 provides for ease of assembly of the framed bundle 140 and insertion thereof into the open end 112 of the outer box 110.

In addition, the front and the back panels 310, 330 of the inner frame 140 have a top edge 360 having a raised portion. In accordance with an embodiment, the top edge 360 is higher (i.e., has a greater length or height) on an outer edge portion 314, 324 nearest the free edges 311, 317, than the inner edge portion 323 attached to the side panel 320. The outer edge portion 314, 324 of the inner frame blank 300 is designed to extend into the hinged lid 130 near the hinge line 271 (FIG. 2), which provides added stability and support to the package 100 upon opening of the hinged lid 130 and removal of a smoking article or cigarette from the package 100. In accordance with an embodiment, the top edge 360 of inner frame 140 on the outer edge portions 314, 324 includes an angulated edge 332 and a vertical edge 334, which converge to form a vanguard 336.

Figure 5:
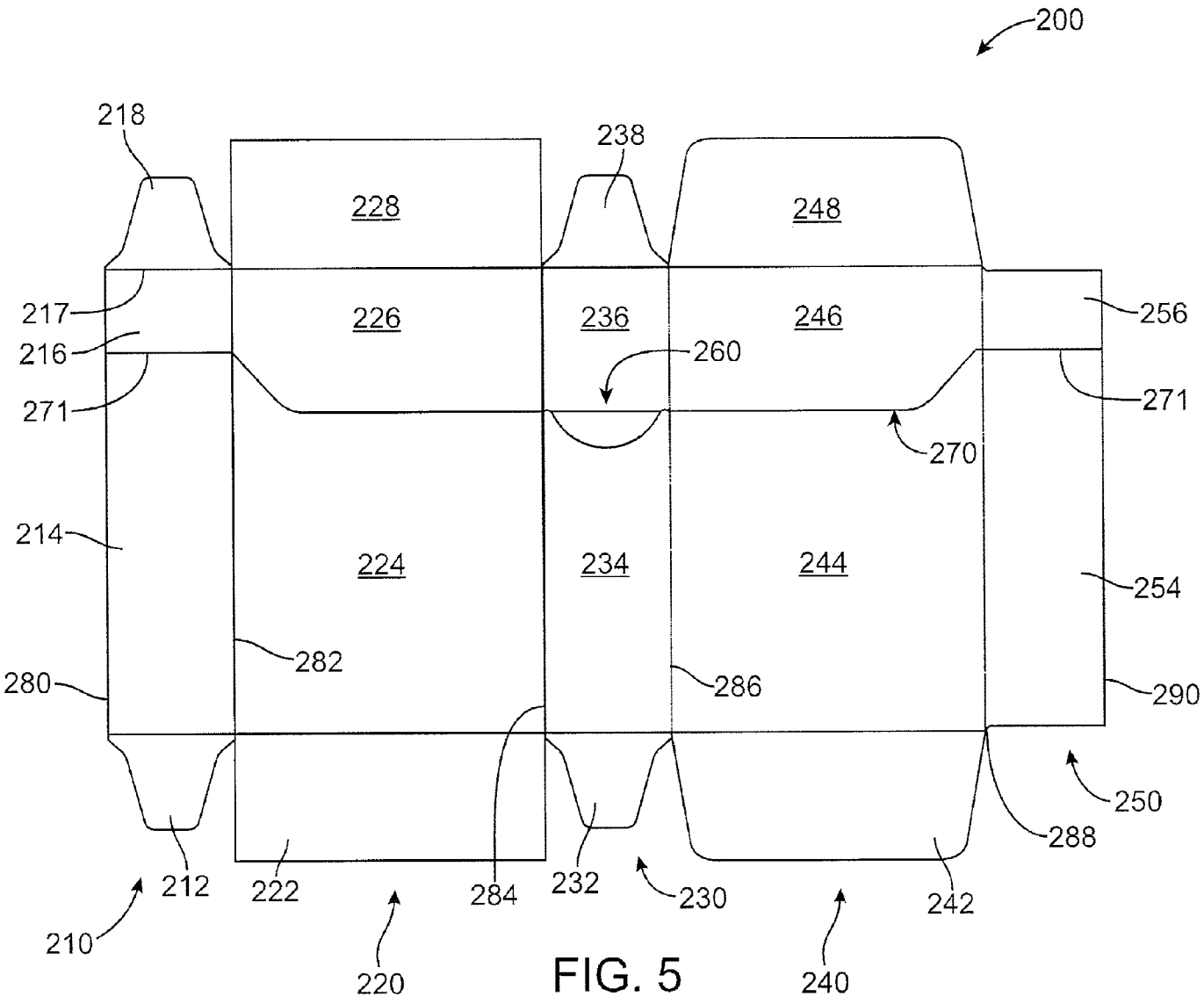
FIG. 5 is a plan view of an outer box blank as shown in FIG. 2 in a spread out state.

The side panel 320 also includes a notch 340, which receives a tab 260, which is attached to a hinged portion 236 of the right panel 230 as shown in FIG. 5. The notch 340 is preferably a cut out section having a rectangular or elliptical shape, which is configured to engage the tab 260. In accordance with one embodiment, the notch 340 is located near the top edge 360 of the side panel 320.

FIG. 5 shows a plan view of an outer box blank 200 prior to assembly. As shown in FIG. 5, the outer box 110, which is formed from the outer box blank 200 includes a left panel 210 having a free edge 280, a front panel 220 attached to the left panel 210 at a fold line 282, a right panel 230 attached to the front panel 220 at a fold line 284, a back panel 240 attached to the right panel 230 at a fold line 286, and a glue panel 250 extending from the back panel 240 at a fold line 288, the glue panel 250 being glued to the underside (not shown) of the left panel 210.

The front panel 220, the right panel 230 and the back panel 240 include a separation line 270, which extends from the fold line 282 between the left panel 210 and the front panel 220 to the fold line 288 between the back panel 240 and the glue flap 250. The separation line 270 divides the front panel 220, right panel 230 and the back panel 240 into a box portion 224, 234, 244 and a hinged top portion 226, 236, 246 for each. As shown in FIG. 5, in a preferred embodiment, the hinged top or hinged lid 130 opens from the side with a hinged left panel 210, which includes a hinge line 271 located on the left panel 210 and the glue panel 250. The hinge line 271 acts as a hinge for the outer box 110, which is comprised of the lower box portion 120 and the hinged lid (or hinged top) 130.

The outer box 110 further includes top and bottom left flaps 212, 218 extending from the left panel 210, top and bottom front flaps 222, 228 extending from the front panel 220, top and bottom right flaps 232, 238 extending from the right panel 230, and top and bottom back flaps 242, 248 extending from the back panel 240. In accordance with one embodiment, the left, right and back flaps 212, 218, 232, 238, 242, 248, are glued to the underside of the front flaps 222, 228.

Figure 6:
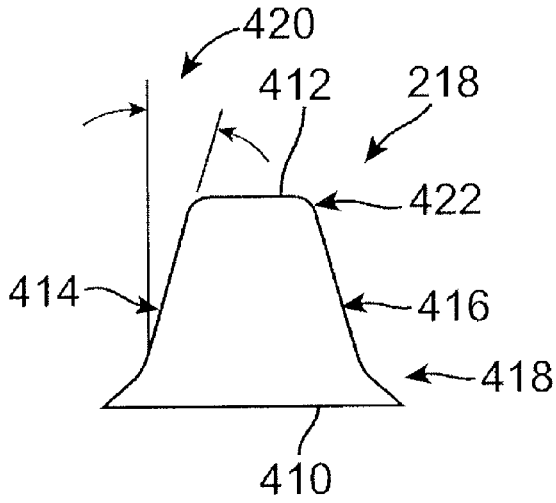
FIG. 6 is a plan view of a flap of a panel of the outer box blank as shown in FIG. 5.

FIG. 6 shows a plan view of the top left flap 218 in accordance with one embodiment. The top left flap 218 has a lower edge 410, which is attached to an upper edge 217 (FIG. 5) of the hinge portion 216 of the left panel 210, and a free upper edge 412. The side edges 414, 416 of the top left flap 218 has a first angled portion 418, which extends from the free lower edge 410 inward from each side 414, 416, at an angle of approximately 30 to 60 degrees to the vertical direction, and a second angled portion 420 at an angle of about 30 to 60 degrees to the vertical direction as shown. The transition 422 from each side 414, 416 to the upper edge 412 is preferably rounded. It can be appreciated that the top left and right flaps 218, 238, and the bottom left and right flaps 212, 232 are preferably similar to one another and as shown in FIG. 6.

Figure 7:
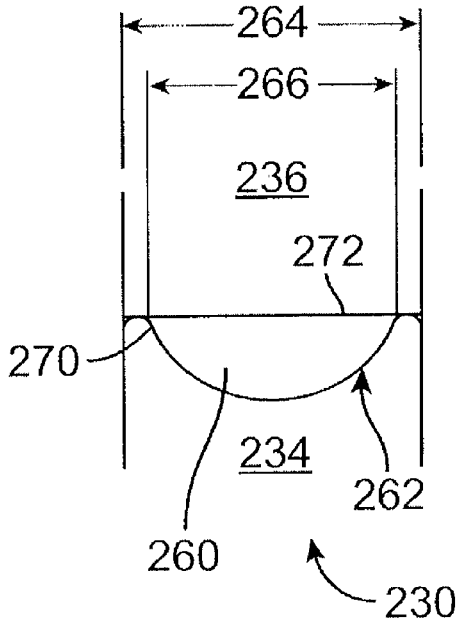
FIG. 7 is a plan view of a portion of a panel of the outer box blank as shown in FIG. 5 including a tab adapted to fit within a notch in the inner frame blank.

FIG. 7 shows a plan view of a portion of the right side panel 230 including the tab 260. As shown in FIG. 7, the right panel 230 includes a box portion 234 and a hinged lid portion 236. The tab 260 extends from the hinged lid portion 236 of the right panel 230. The separation line 270 extends downward from the hinged lid portion 236 having a curved edge 262. The curved edge 262 extends from a hinge line 272, which extends from the separation line 270 of the front and back panels 220, 240. The right panel 230 has a width 264, which is slightly greater than a width 266 of the tab 260, which allows the tab 260 to engage the notch 340 within the inner frame 300 when the hinged lid 130 is in a closed position.

It can be appreciated that in accordance with one embodiment, that when cigarette package 100 is opened, the hinged lid 130 disengages the tab 260 from the notch 340 in the inner frame 140. The tab 260 and the notch 340 act as a retention mechanism to hold the hinged lid 130 in place while the hinged lid 130 is in a closed position. In addition, the tab 260 and the notch 340 make a "clicking" noise when opened and closed, which provides an auditory acknowledgment that the package 100 has been opened and/or closed.

Figure 8:
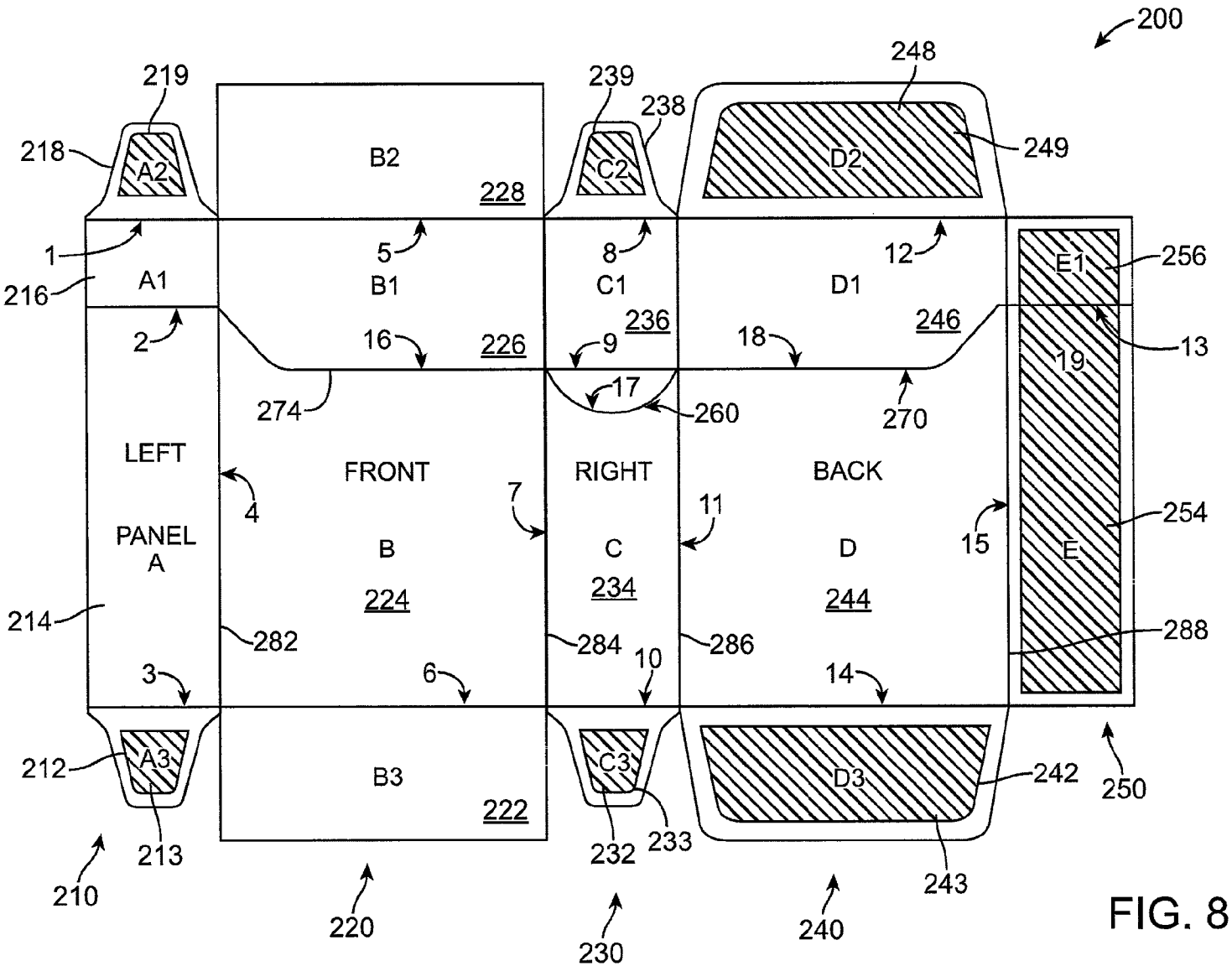
FIG. 8 is a blank of the outer box according to FIG. 5 showing the panel, score, cut and perforation/score identification in accordance with one embodiment.

FIG. 8 is a blank of the outer box blank 200 according to FIG. 5 showing the panel, score, cut and perforation/score identification in accordance with one embodiment. As shown in FIG. 8, the outer box blank 200 includes a left panel 210, a front panel 220 attached to the left panel 210 at a fold line 282, a right panel 230 attached to the front panel 220 at a fold line 284, and a back panel 240 attached to the left panel at a fold line 286. A glue panel 250 extends from the back panel 240 at a fold line 288.

The outer box blank 200 includes top and bottom left glue flaps 213, 219 extending from the left panel 210, top and bottom right glue flaps 233, 239 extending from the right panel 230, and top and bottom back glue flaps 243, 249 extending from the back panel 240. In accordance with one embodiment, the left, right and back glue flaps 213, 219, 233, 239, 243, 249, are glued to the underside of the front flaps 222, 228. In addition, the glue panel 250 glues to the underside of the left panel 210.

The back and front panels 220, 240, further include a separation line 270, which forms the hinged lid (or hinged top) 130 of the outer box 110. As shown in FIG. 8, the outer box blank 200 is scored (i.e., introduction of a hinge line or fold line) to assist with the folding of the panels and gluing of the outer box 110. In addition, a cut line or perforation line 274 is introduced into the outer box blank 200 to form the hinged lid (or hinged top) 130. As shown in FIG. 8, the scores lines 1-15 and the cut lines 16-18 can be introduced into the blank 200 simultaneously or sequentially beginning with score line 1, score line 2, and so on. In addition, the cut lines 16-18 can be introduced simultaneously or sequentially following a similar sequence beginning with cut line 16, cut line 17 and then cut line 18.

In accordance with a preferred embodiment, the outer box 110 is fed into a box forming device as a blank 200, wherein the outer box blank 200 is folded at fold line 286 into a bottom portion comprising the left panel 214, the front panel 224, and right panel 234 and a top portion comprising the back panel 244 and glue panel 254. The underside of the left panel 214 is folded at the fold line 282 and glued to the glue panel 254. The gluing of the underside of the left panel 214 forms a collapsed outer box 110.

The outer box 110 is then preferably fed through a packing apparatus, wherein the opposed edge comprising the left panel 210 and the right panel 230 of the collapsed outer box 110 move towards each other to open the outer box 110. The bottom flaps 212, 222, 232, 242 at one end of the outer box 110 move outwardly to form an open end 112 (FIG. 2) of the outer box 110. The framed bundle 140 with the inner frame 150 is then inserted through the open end 112 of the outer box 10. The top flaps 218, 228, 238, 248 and the bottom flaps 212, 222, 232, 242 are closed to form a completed cigarette package 100. It can be appreciated that alternative embodiments of the outer box 110 can include additional panels and/or end flaps, which are closed to form the completed cigarette package 100.

As shown in FIGS. 9A-9E, the hinge lid box or pack 100 includes a lower box or body portion 120 having a left side panel 210, a front panel 220, a right side panel 230, and a back panel 240 (not shown). The box or pack 100 also includes a hinged lid 130, an inner frame 140, and a hinge 271 defined across the left side panel 210 so that the hinged lid 130 is rotatable from a closed position to an opened position at an angle relative to the front panel 220 (and corresponding back panel 240). In accordance with an embodiment, the inner frame 140 allows for a horizontal separation line or cut line 270 between the hinged lid 130 and the lower box portion 120 and the upper or top edge 360 of the inner frame 140. In addition, the inner frame 140 allows for the horizontal separation line or cut line 270 to extend across a substantial portion, or alternatively almost entirely all of the way across the face of the front and back panels 220, 240 of the pack 100.

Figure 9A:
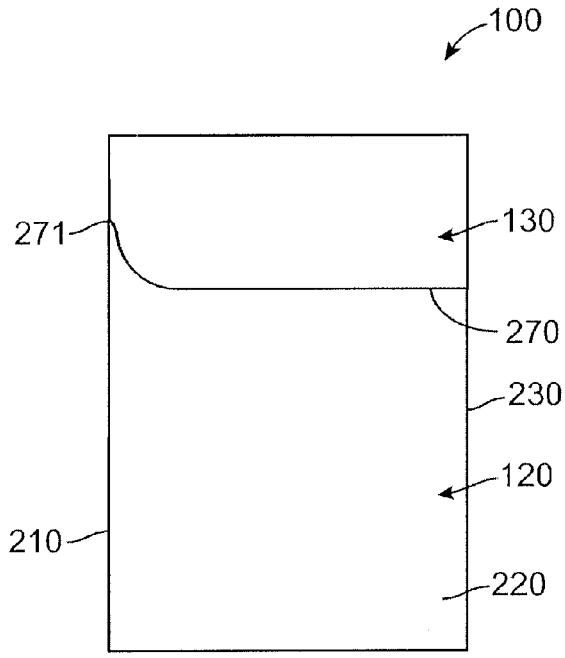
FIGS. 9A-9E are a series of side views showing the cigarette package and inner frame as the hinged lid is opened.
Figure 9B:
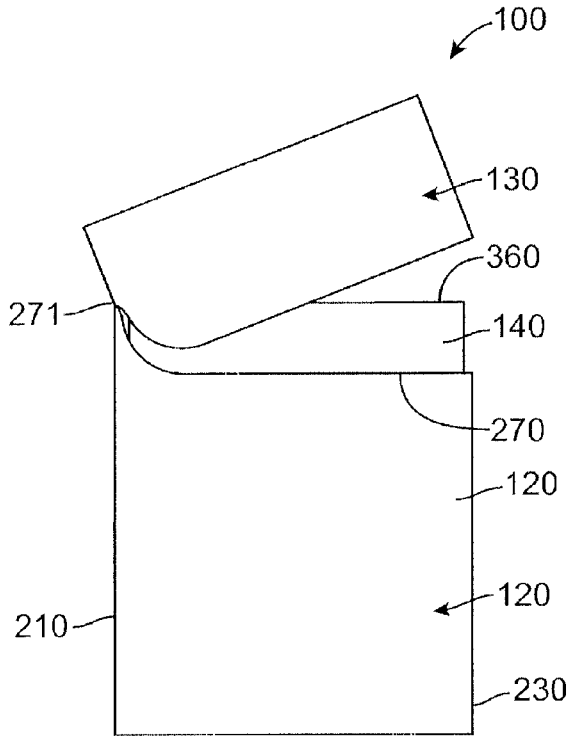
Figure 9C:
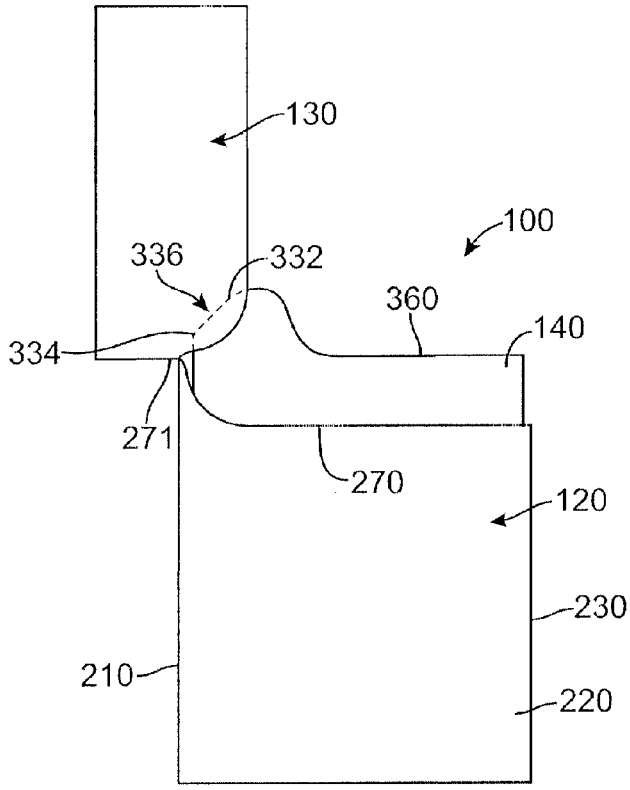
Figure 9D:
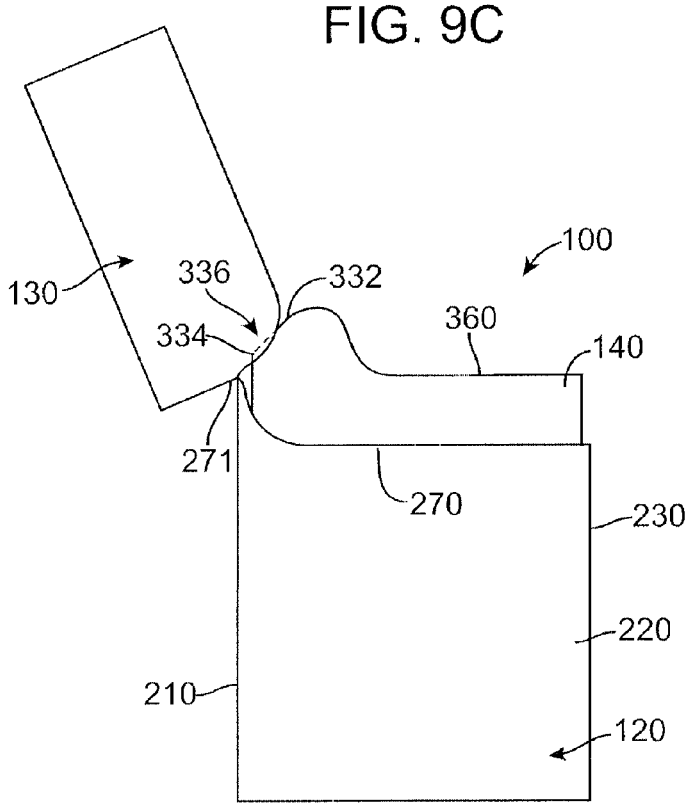
Figure 9E:
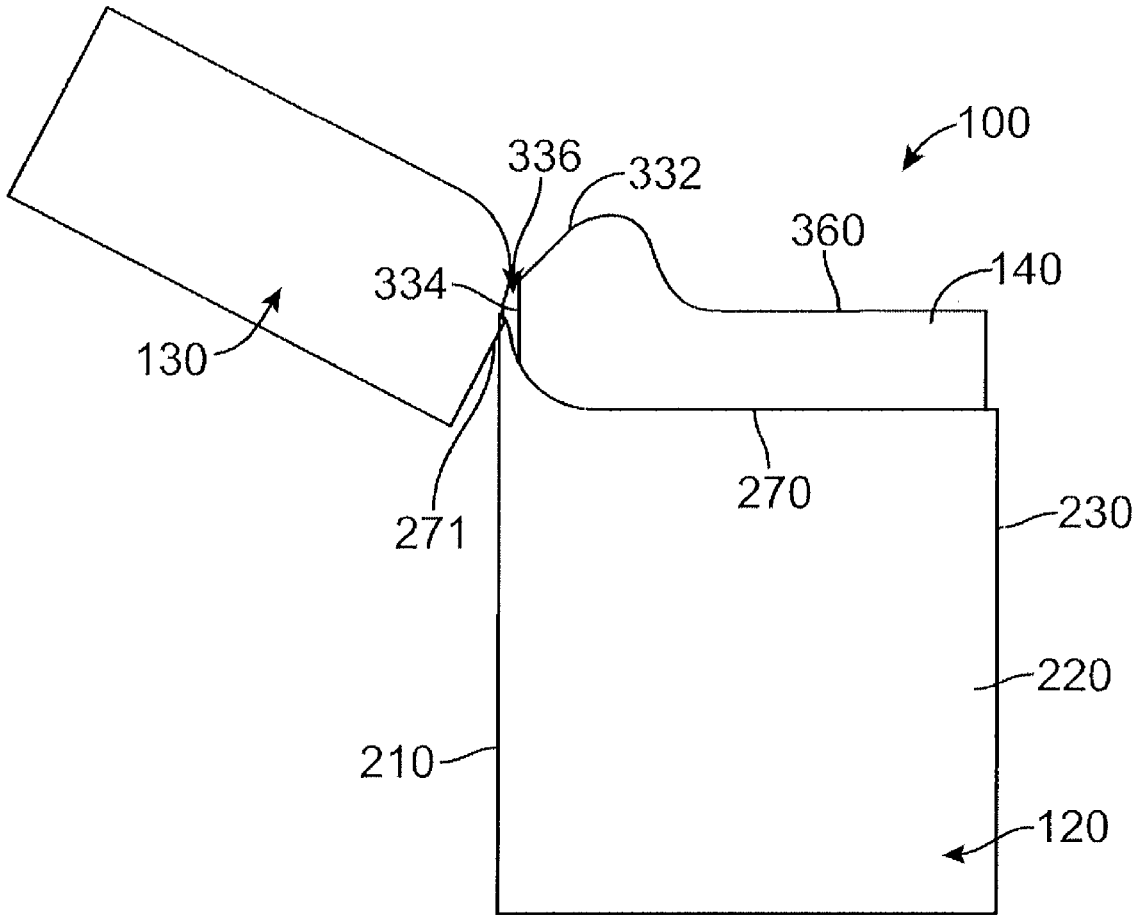

As shown, the top edge 360 of inner frame 140 on the outer edge portions 314, 324 (FIG. 4) includes an angulated edge 332 and a vertical edge 334, which converge to form a vanguard 336 (i.e., the forefront of an action or movement), which is adjacent to the hinge 271. The angulated edge 332 and the vertical edge 334 are preferably straight, however, it can be appreciated that the either or both of the edges 332, 334 can be arcuate. In accordance with an embodiment, the vanguard 336 is preferably defined at least in part by the vertical edge 334 of the inner frame 140 adjacent the hinge 271. In a preferred embodiment, as shown in FIGS. 9C-9E, the vanguard 336 has a somewhat point-like shape.

During use, the vanguard 336 reduces edge to edge snags between the lid 130 and the inner frame 140 during reclosure. In addition, the vertical edge 334 of the vanguard 336 acts as a stop against the tendency of the hinged lid 130 to want to move to the left (i.e., backwards) from the retention mechanism.

In a preferred embodiment, the cigarette package 100 as shown in FIGS. 1-9 can be run on standard high speed packaging equipment.

Although the methods, apparatuses and packaging has been described in terms of the preferred embodiments thereof, it will be appreciated by those skilled in the art that additions, deletions, modifications, and substitutions not specifically described can be made without departing from the spirit and scope of the embodiments as defined in the appended claims.

What is claimed is:

1. A cigarette package comprising:

an outer box, the outer box including a lower box portion and a side opening hinged lid, and wherein the side opening hinged lid covers an opening in the lower box portion; and an inner frame, which prevents the hinged lid from misaligning when the hinged lid is opened past the inner frame and closed, the inner frame including a front panel, a back panel, and a side panel extending between the front panel and the back panel, wherein a top edge of each of the front panel and the back panel of the inner frame includes an angulated edge and a vertical edge which converge to form a vanguard.

2. The cigarette package of claim 1, further comprising a group of cigarettes wrapped in a foil wrapper and adapted to fit within the outer box.

3. The cigarette package of claim 2, wherein the group of cigarettes wrapped in the foil wrapper are positioned within the inner frame.

4. The cigarette package of claim 1, wherein the outer box includes a tab and the inner frame includes a notch, and wherein the notch disengages from the tab when the hinged lid is opened and engages the tab when the hinged lid is in a closed position.

5. The cigarette package of claim 1, wherein the front and the back panel of the inner frame has a horizontal edge extending from the side panel, a first angulated edge extending upwardly from the horizontal edge, a rounded top edge extending from the first angulated edge, a second angulated edge extending downwardly from the rounded top edge and a vertical edge extending from the second angulated edge, the second angulated edge being short than the first angulated edge top edge.

6. The cigarette package of claim 1, wherein the outer box includes a left panel having a free edge, a front panel attached to the left panel at a fold line, a right panel attached to the front panel at a fold line, a back panel attached to the right panel at a fold line, and a glue panel extending from the back panel at a fold line, the glue panel being glued to an underside of the left panel.

7. The cigarette package of claim 6, wherein the outer box further includes top and bottom left flaps extending from the left panel, top and bottom front flaps extending from the front panel, top and bottom right flaps extending from the right panel, top and bottom back flaps extending from the back panel, the left, right and back flaps being glued to an underside of the front flaps.

8. A cigarette package comprising:

an outer box, the outer box including a lower box portion and a side opening hinged lid, the side opening hinged lid having a tab, and wherein the side opening hinged lid covers an opening in the lower box portion;

an inner frame having a notch therein; and wherein the notch engages the tab when the hinged lid is in a closed position, and wherein a top edge of each of the front panel and the back panel of the inner frame includes an angulated edge and a vertical edge which converge to form a vanguard.

9. The cigarette package of claim 8, further comprising a foil bundle comprising a group of cigarettes in a foil wrapper and adapted to fit within the outer box.

10. The cigarette package of claim 9, wherein the foil bundle is positioned within the inner frame.

11. A cigarette package comprising:

an outer box, the outer box includes a left panel having a free edge, a front panel attached to the left panel at a fold line, a right panel attached to the front panel at a fold line, the right panel having a tab, a back panel attached to the right panel at a fold line, and a glue panel extending from the back panel at a fold line, the glue panel being glued to an underside of the left panel; and an inner frame, the inner frame including a front panel, a back panel, and a side panel extending between the front and back panels, the side panel having a notch, which engages the tab when a hinged lid portion of the outer box is in a closed position, wherein a top edge of each of the front panel and the back panel of the inner frame includes an angulated edge and a vertical edge which converge to form a vanguard.

12. The cigarette package of claim 11, further comprising a group of cigarettes wrapped in a foil wrapper and adapted to fit within the outer box.

13. The cigarette package of claim 11, wherein the outer box further includes top and bottom left flaps extending from the left panel, top and bottom front flaps extending from the front panel, top and bottom right flaps extending from the right panel, top and bottom back flaps extending from the back panel, the left, right and back flaps being glued to the underside of the front flaps.

14. The cigarette package of claim 11, wherein the inner frame extends beyond an upper portion of the outer box and the hinged lid is moveable from an open position at which the hinged lid extends beyond the inner frame to a closed position at which the hinged lid is guided onto the inner frame.

15. A hinge lid box comprising a lower body portion having a front panel and a side panel said box further comprising an inner frame, a lid and a hinge defined across said side panel so that the lid is rotatable from a closed position to an opened position at an angle relative to said front panel, said inner frame including a front panel having a top edge and a back panel having a top edge, the top edge of each of the front panel and the back panel including an angulated edge and a vertical edge which converge to form a vanguard adjacent said hinge to reduce edge to edge snags between the lid and the inner frame during reclosure.

16. The hinge lid box of claim 15, wherein said vanguard is defined at least in part by a vertical edge of said inner frame adjacent said hinge.

* * * * *